US007870884B2

(12) United States Patent
Montero

(10) Patent No.: US 7,870,884 B2
(45) Date of Patent: Jan. 18, 2011

(54) METHOD FOR CASTING MOLDED PARTS

(75) Inventor: Gelson Montero, Oftersheim (DE)

(73) Assignee: Hos Hottinger Systems GBR (DE)

( * ) Notice: Subject to any disclaimer, the term of this patent is extended or adjusted under 35 U.S.C. 154(b) by 710 days.

(21) Appl. No.: 11/412,275

(22) Filed: Apr. 27, 2006

(65) Prior Publication Data

US 2006/0185814 A1 Aug. 24, 2006

Related U.S. Application Data

(63) Continuation of application No. PCT/DE2004/002302, filed on Oct. 15, 2004.

(30) Foreign Application Priority Data

Oct. 28, 2003 (DE) ..... 103 50 371
Dec. 23, 2003 (DE) ..... 103 61 535

(51) Int. Cl.
*B22D 27/04* (2006.01)

(52) U.S. Cl. ..... 164/47; 164/6; 164/122

(58) Field of Classification Search ..... 164/47, 164/6, 122, 45
See application file for complete search history.

(56) References Cited

U.S. PATENT DOCUMENTS 4,222,429 A * 9/1980 Kemp ..... 164/34

FOREIGN PATENT DOCUMENTS

| | | |
|---|---|---|
| DE | 2 164 698 | 7/1973 |
| DE | 31 48 461 C1 | 4/1983 |
| DE | 32 00 193 A1 | 7/1983 |
| DE | 33 05 839 A1 | 8/1984 |
| EP | 0 890 400 A1 | 1/1999 |
| GB | 2 230 720 A | 10/1990 |

OTHER PUBLICATIONS

Brunhuber, E.: "GIESSEREILEXIKON" 1983, Schiele & Schön, Berlin, pp. 923, paragraphs 2-3.

* cited by examiner

*Primary Examiner*—Kevin P Kerns
(74) *Attorney, Agent, or Firm*—Alston & Bird LLP

(57) ABSTRACT

A method for casting molded parts, comprising the following steps: The mold is prepared by forming a core packet from the cores which are made of molding sand; the metal melt is poured into the mold; the mold is thermally insulated prior to and/or after casting and the thermal process is used in a known manner inside the mold and/or insulation for controlled treatment of the cast molded part and/or the material forming the core packet.

6 Claims, No Drawings

METHOD FOR CASTING MOLDED PARTS

CROSS REFERENCE TO RELATED APPLICATION

The present application is a continuation of international application PCT/DE2004/002302, filed 15 Oct. 2004, and which designates the U.S. The disclosure of the referenced application is incorporated herein by reference.

BACKGROUND OF THE INVENTION

The invention relates in a very generally to the casting of molded metal parts, i.e., foundry technology. For casting of molded parts of any type, casting cores and/or molds are usually produced from separate parts, put together, and joined to make a casting mold, or a core packet or mold packet. These mold/core packets are then filled with molten metal for producing, for example, a metal workpiece, whereby in mass production the mold/core packets to be filled with molten metal pass through the assembly line in succession.

Core and shell mold shooting machines for producing cores to be joined together have been known in practice for decades. Solely by way of example, reference is made here to DE 31 48 461 C1, which discloses such a core and shell mold shooting machine.

Heretofore, molded parts have been cast in a mold composed of cores or a core packet. After the mold is shot and formed, it is integrated into an additional mold or enclosure made of core sand to ensure the necessary mechanical stability.

Regardless of the actual casting procedure, afterwards the molding sand which forms the mold/core packet must be removed from the cast molded part. Because of the binder, special disposal or recycling of the molding sand is necessary, which requires significant effort.

The method known from the prior art has significant energy requirements in the form of heat, introduced into the mold packet from the melt, which heretofore has been more or less lost through the cooling process. Furthermore, additional energy must be expended for annealing the binder and thus for recycling the molding/core sand.

An object of the present invention is to design and refine the previously described method in such a way that optimum use is made of the energy used for casting.

SUMMARY OF THE INVENTION

The above and other objects and advantages of the present invention are achieved by the provision of a casting method which comprises the steps of:

preparing a mold which is formed from a core packet which comprises cores made of a material which comprises molding sand, pouring a heated metallic melt into the mold, thermally insulating the mold before and/or after the pouring step, and using the process heat generated from the heated metallic melt within the mold for the controlled in situ treatment of the resulting molded part and/or the material forming the core packet.

In a further advantageous manner, the process heat may be used for combusting the organic or inorganic binder in the molding sand, thereby eliminating the need for special recycling measures afterwards. Special disposal of the molding sand as hazardous waste is likewise no longer necessary, in the event that the molding sand is not to be reused.

The process heat may also be used for heat treating of the cast molded part.

In a very particularly preferred approach, the molded part may be cooled in a controlled way, very particular importance being attached to the thermal insulation around the actual core packet.

It is also possible to exhaust gases from the interior of the mold and/or the insulation during the in situ heat treatment.

Very particular importance is attached to a further feature in which it is advantageous to use individual cores designed as hollow bodies for the formation of the core packet. This has the enormous advantageous that the mass of the core sand material is kept to a minimum so that the greatest possible use can be made of the energy present in the form of heat within the overall system for treating the cast molded part and/or the core packet, thus, for example, for combusting the binder.

It is also advantageous for the combustion gases produced during combustion of the binder to be retained inside the structure of the thermal insulation. The combustion gases may be exhausted at the end of the insulation process. The presence of contaminant gases in concentrated form greatly facilitates their disposal or destruction, thereby significantly simplifying the process.

To avoid redundancy, in other respects reference is made to the general part of the description above.

Lastly, it is noted that the exemplary embodiment described above is used solely by way of example to explain the claimed teaching, which, however, is not limited to the exemplary embodiment.

That which is claimed:

1. A method for casting molded parts, comprising the steps of preparing a mold which is formed from a core packet which comprises cores made of a material which comprises molding sand, pouring a heated metallic melt into the mold, thermally insulating the mold before and/or after the pouring step, using the process heat generated from the heated metallic melt within the mold for the controlled in situ treatment of the resulting molded part and/or the material forming the core packet, combusting a binder for the molding sand using the process heat, and retaining the gas produced during combustion of the binder inside the thermal insulation during the controlled in situ heat treatment of the molded part and/or the material forming the core packet.

2. The method of claim 1, wherein the process heat is used for heat treating of the molded part.

3. The method of claim 1, wherein the molded part or the overall system is cooled in a controlled manner.

4. The method of claim 1, wherein gas is exhausted from the interior of the mold and/or the insulation during the controlled in situ heat treatment of the molded part and/or the material forming the core packet.

5. The method of claim 1, wherein heat is added through the thermal insulation in a controlled manner during the in situ heat treatment step.

6. The method of claim 1, wherein cores with a partially hollow design and having a reduced mass are also used for forming the core packet.

* * * * *